United States Patent [19]

Lenker et al.

[11] 3,941,017

[45] Mar. 2, 1976

[54] PLIER TYPE RATCHET WRENCH

[75] Inventors: Paul E. Lenker; Raymond G. Voss, both of Davenport, Iowa

[73] Assignee: Davenport Tool Co., Eldridge, Iowa

[22] Filed: June 19, 1975

[21] Appl. No.: 588,190

Related U.S. Application Data

[63] Continuation-in-part of Ser. No. 567,750, April 14, 1975, abandoned.

[52] U.S. Cl. ..... 81/57.39; 81/58.1

[51] Int. Cl.[2] ..... B25B 13/46

[58] Field of Search ..... 81/57.39, 60, 61, 58.1

[56] References Cited

UNITED STATES PATENTS

| | | | |
|---|---|---|---|
| 1,398,180 | 11/1921 | Dietrich | 81/58.1 |
| 3,270,595 | 9/1966 | Hall et al. | 81/57.39 |
| 3,616,714 | 11/1971 | Gregory | 81/57.39 |

*Primary Examiner*—James L. Jones, Jr.
*Attorney, Agent, or Firm*—Haven E. Simmons; James C. Nemmers

[57] ABSTRACT

A plier-type ratchet wrench of simple, economical and robust construction employs a single rigid thrust rod or bar to operate the ratchet drive and a single extensible helical spring which both biases the operating handle to its normal position and keeps the thrust rod and a pawl engaged with the ratchet.

8 Claims, 3 Drawing Figures

PLIER TYPE RATCHET WRENCH

CROSS REFERENCE TO RELATED APPLICATION

This application is a continuation-in-part of application Ser. No. 567,750, filed Apr. 14, 1975 now abandoned.

BACKGROUND OF THE INVENTION

There are several types of hand-operated, plier-type ratchet wrenches, distinguished chiefly by the manner in which hand operation drives the ratchet. Basically, so far as known, these are the gear types, the hydraulic types, and the essentially link and thrust rod types. The hydraulic types, such as in U.S. Pat. Nos. 2,508,568; 2,708,383; and 2,983,172, tend to be heavy and expensive which alone militates against them. Besides, they can leak and so become disabled. The gear types seem to break down pretty much into two classes, those using pinion or sector gears or both, as in U.S. Pat. Nos. 1,121,668; 1,970,721; 2,633,044; 2,831,384; 3,286,560; and 3,557,644, and those using rack gears at the ends of push rods as in U.S. Pat. Nos. 2,817,257; 3,413,877; 3,616,714; 3,682,088; and 3,726,161. There is even a combination of both in U.S. Pat. No. 919,260. But the gear types, whether pinion, sector or rack, are also expensive to fabricate and tend also to be relatively complex. In addition, the use of racks requires more space. On the other hand, however, the essentially link and thrust rod types as in U.S. Pat. Nos. 1,204,095; 1,543,338; 2,471,194; 2,726,563; and 2,954,715, which ought to avoid the disadvantages set forth of the other types, unfortunately likewise tend to be more complex and thus expensive to manufacture than they need or should be, or otherwise suffer from design faults which impair their efficiency. It is thus the chief object of the present invention to provide a plier-type ratchet wrench of the link and thrust rod type which is efficient, but simple, economical of construction and robust.

SUMMARY OF THE INVENTION

A number of important features in the wrench of the present invention contribute to its object stated above. Perhaps the most important of these is centered around the use of a single extensible helical spring, always in tension, to perform essentially three functions. The first two are to bias both the operating handle and the thrust bar, which drives the ratchet, to their normal positions, while the third is to hold the pawl in engagement with the ratchet. No seat, recess or sleeve for the spring is therefore necessary since it is always in tension rather than compression; no special guides or guideways are needed for the thrust rod so fabricating time and costs are reduced; and last but not least, friction is held to a minimum so that operator fatigue is less.

Single helical springs are used in U.S. Pat. Nos. 3,286,560 and 3,726,161 mentioned above, but they are of the compression type, requiring extra and relatively expensive manufactures to locate and steady them so that they can function. Furthermore, because of their need for seats or guides, they suffer more from sliding friction than do extensible springs. In U.S. Pat. No. 3,616,714 noted above a single extensible spring is used but no pawl, though there is no recognition in that patent of the foregoing advantages of extensible over compressible springs. But because there is no pawl in the wrench of that patent it must rely heavily for its operation upon internal friction. If the latter were not present and since there is no pawl, a loose nut, for instance, would turn both ways as the wrench were operated and thus would not be removed further. The friction involved exists between the cam faces of the movable handle and the rack bar and between the latter and its guide pin, all with the result that the wrench is very tiring to operate. Also, the rack bar during operation of the wrench extends significantly beyond the outline of the tool which may not only impede its operation in tight places but permit its abuse by pulling the rack bar out, stretching the spring beyond its elastic limit, and so permanently damaging the wrench.

In the present invention a separate pawl is used eliminating the need for internal friction in order for the wrench to function and hence making it less tiresome to use. The single extensible spring is simply anchored at its ends to the pawl and the thrust bar so that it not only biases the operating handle and thrust bar to their normal positions and the thrust bar against the ratchet, but also the pawl into engagement with the latter. Another feature is the pawl itself, in the shape of a parallelepiped block which can be simply cut from bar stock and so avoids the machining needed for pawls of more elaborate configurations. Other features include the use of a captive ball joint between the operating handle and one end of the thrust bar which is more economical than a pinned interconnection and much less frictional than sliding or cam face contact. The thrust bar itself is a slim, one-piece item with a single drive nose at its other end for actuating the ratchet and always remains within the outline of the tool. Other advantages of the present invention will appear from the drawings and the more detailed description which follows.

DETAILED DESCRIPTION OF THE PREFERRED EMBODIMENT

Figure 1:
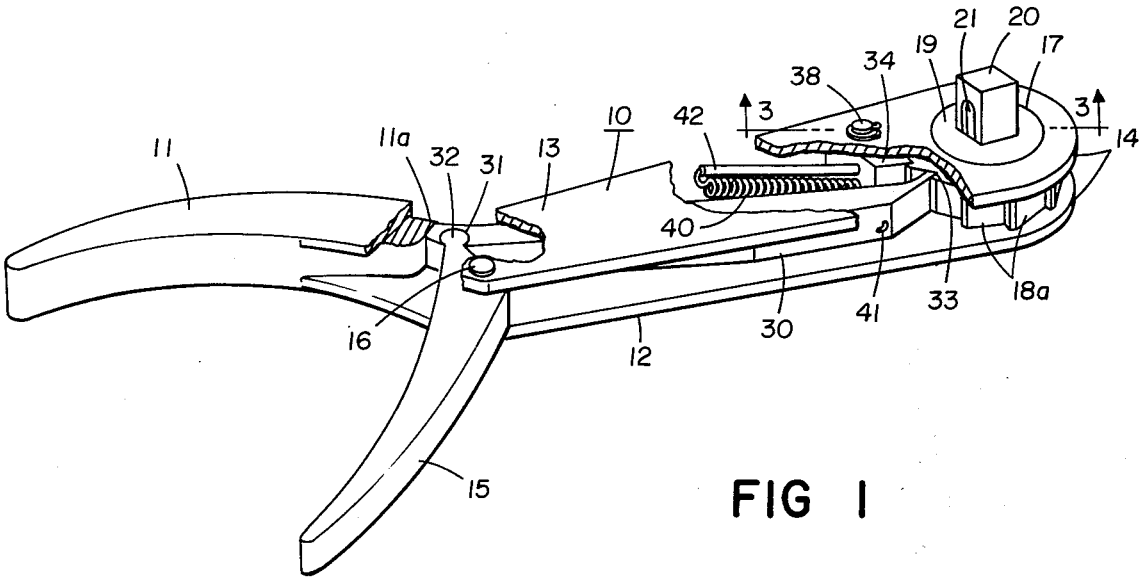
FIG. 1 is an isometric view of the wrench of the present invention shown in its normal position, certain portions being broken away to illustrate its inner structure.
Figure 3:
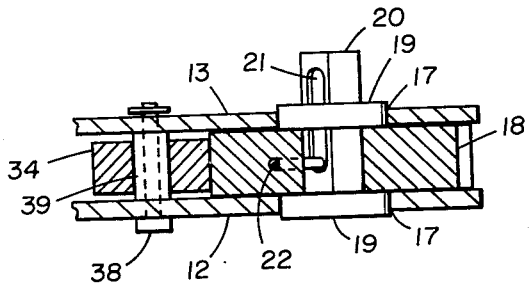
FIG. 3 is a detail sectional view taken along the line 3—3 of FIG. 1.

The wrench consists essentially of an elongated, integral member or body 10. One end of the body 10 is machined to form a fixed, curved handle 11 having an abutment 11a at its inner end between the roots of a pair of parallel, spaced leaves 12 and 13, radiused at their outer ends 14, formed from the remainder of the body 10 and between which are located and carried the remaining parts. The first of the latter includes a second curved handle 15 which is pivoted at its inner end between the leaves 12 and 13 on a headed pin 16 therethrough adjacent the inner end of the handle 11 and retained by a snap ring. The outer leaf ends 14 are align bored through at 17 and receive therebetween a drive ratchet and shank assembly consisting of an annular ratchet 18 having integral bosses 19 on its opposite faces. The ratchet 18 is inserted between the leaves 12 and 13 by springing the latter apart so that upon their release the bosses 19 are journaled in the bores 17 about an axis parallel to that of the pin 16. The bosses 19 are broached to receive an axially slidable, square drive shank 20 having a keyway 21 in one face thereof in which operates the inner end of a rollpin 22 radially inserted through the outer periphery of the ratchet 18 in order to retain the shank 20. Each end of the shank 20 is provided with a suitable bayonnet fitting 23 (only one being shown) in order to retain a socket for use with the wrench.

The ratchet 18 is driven by an elongated, integral thrust rod or bar 30. The inner end of the latter is provided with a transverse cylindrical seat 31 in which is pivotally captured a transverse cylindrical boss 32 integrally formed on the inner end of the handle 15 about an axis parallel to pin 16. That axis is also offset from that of the pin 16 so that squeezing the handles 11 and 15 together drives the bar 30 longitudinally of the leaves 12 and 13 toward their outer ends 14. The seat 31 and boss 32 of the handle 15 and the bar 30 are first slidably assembled and then the latter two inserted between the leaves 12 and 13 before the pin 16 is inserted. When in place and the handle 15 is in its open or normal position, the end of the bar 30 adjacent the seat 31 engages the abutment 11a. The bar 30 tapers towards its outer end which is formed to provide a slightly cranked, single drive nose 33 which operatively engages and drives the ratchet teeth 18a as the bar 30 moves longitudinally toward the leaf ends 14. At the same time, the bar 30 moves laterally toward the adjacent outer edges of the leaves 12 and 13 as the nose 33 drives around the ratchet 18 in the direction indicated by the arrow in FIG. 2. In order to prevent the ratchet 18 from turning in the opposite direction, a detent is provided in the form of a pawl 34 which is of parallelepiped shape and simply cut from suitable bar stock. Two of the pawl faces 35 and 36, which form an acute angle, provide a detent nose 37 engaging the ratchet teeth 18a. The pawl 34 is pivoted on a second headed pin 38, also retained by a snap ring, through the body of the pawl 34 and the leaves 12 and 13 parallel to the pin 16. In order to ensure that the pawl 34 moves freely, the latter includes a bushing 39, rotable about the pin 38, which is inserted into the pawl 34 and stands just proud of the pawl faces opposite the leaves 12 and 13.

Figure 2:
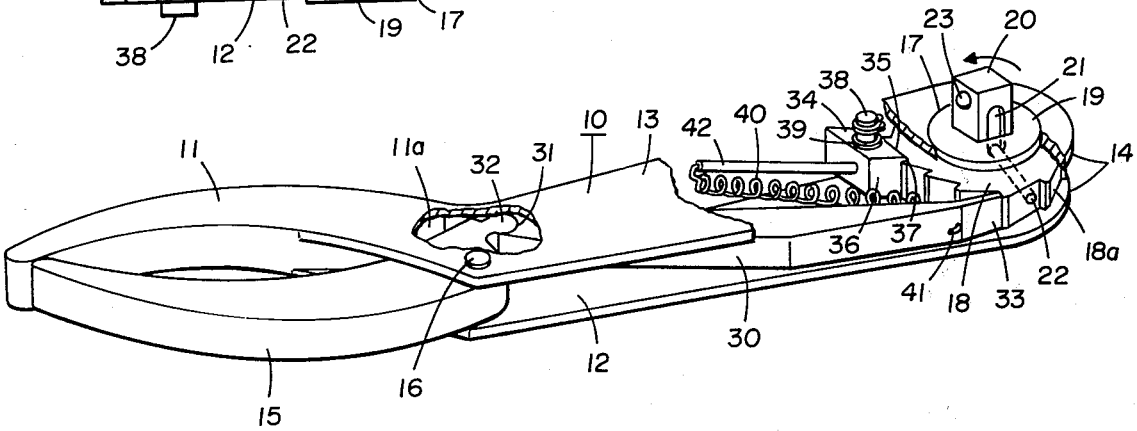
FIG. 2 is similar to FIG. 1 but illustrates the wrench after it has been driven by squeezing its handles together, further portions being broken away to show additional features of its construction.

The thrust bar 30 and pawl 34 are operatively biased by an extensible helical spring 40 disposed generally parallel to the bar 30 between the latter and the pawl face 36. One end of the spring 40 is hooked through a drilling 41 through the bar 30 adjacent its drive nose 33 while its other end is hooked into the outer end of a small tube 42, in the form of a rollpin, generally parallel to the bar 30 and spring 40 and socketed at its other end in the pawl face opposite its face 35. The pawl 34 with the bushing 39 and tube 42 are first assembled, and then, after the spring 40 is hooked to the thrust bar 30 and the tube 42, are inserted between the leaves 12 and 13 and the pin 38 driven home. The length of the spring 40 is such that it is in tension when the wrench is in its normal position illustrated in FIG. 1 with the thrust bar engaged with the abutment 11a and then even more so as it is further extended when the handles 11 and 15 are squeezed together as shown in FIG. 2. In both instances, the always present tension of the spring 40, owing first to the abutment 11a limiting return movement of the thrust bar 30 and thereafter to the increasing tension of the spring 40, keeps both the thrust bar 30 and the pawl 34 in constant engagement with the ratchet 18 as well as the handle 15 and the thrust bar 30 in the normal position shown in FIG. 1. As previously pointed out, all this is accomplished without the need of any special seats or sleeves for the spring 40 or guideways for the thrust bar 30. Since internal friction is unnecessary for the wrench to operate, that can be kept low so as to tire the user as little as possible. Assembly of the parts, as will be apparent, is a relatively, simple straightforward operation. For the same reason, the wrench is also easily repairable. Simply by removing the two pins 16 and 38 and springing the two leaves 12 and 13 apart, all the parts can be extracted for replacement or repair. This is an important feature, especially to the professional mechanic.

Though the present invention has been described in terms of a particular embodiment, being the best mode known of carrying out the invention, it is not limited to that embodiment alone. Instead, the following claims are to be read as encompassing all adaptations and modifications of the invention falling within its scope and spirit.

We claim:

1. In a tool of the type described including an elongated first member having opposite first and second end portions, the first end portion constituting a fixed handle; a second elongated member constituting a movable handle and pivoted adjacent one end to the first member about a first axis disposed intermediate the fixed handle and the second end portion of the first member for actuation by the hand of a user so that the fixed and movable handles can be squeezed from a maximum open position toward a close position relative to each other; a drive member disposed adjacent the second end portion of the first member for driving rotation about a second axis parallel to the first axis, the drive member including a drive ratchet about a peripheral surface thereof concentric with the second axis; and operating means carried by the first member disposed generally between the movable handle and the drive member and operatively associated with the movable handle and the drive ratchet for driving rotation of the drive member upon said actuation of the handles, the improvement wherein the operating means comprises: an elongated rigid thrust bar having opposite first and second ends disposed between the movable handle and the drive ratchet, the first end of the thrust bar being pivotally connected to the movable handle about a third axis parallel to the first axis, the second end of the thrust bar constituting a drive nose engaging the drive ratchet so that the thrust bar imports driving rotation in one direction to the drive member upon said actuation of the handles; a pawl pivoted to the first member about a fourth axis parallel to the first axis, the pawl being laterally spaced from the second end of the thrust bar and engaging the drive ratchet effective to prevent rotation thereof in the opposite direction; and a single extensible helical spring disposed in tension between the thrust bar and the pawl effective through the thrust bar to hold the movable handle in said open position and to hold each of the thrust bar drive nose and the pawl in engagement with the drive ratchet, squeezing of the handles toward their close position extending the spring against its tension.

2. The tool of claim 1 wherein the pawl includes an extension thereof toward the first end of the thrust bar and laterally spaced therefrom, the spring being disposed in tension between the pawl extension and the thrust bar with its axis generally parallel to the latter, one end of the spring being secured to the outer end of the pawl extension and the other end to the thrust bar adjacent its drive nose.

3. The tool of claim 2 wherein the pawl comprises a block of generally parallelepiped shape having a pair of its faces forming an acute angle and constituting a detent nose engaging the drive ratchet as aforesaid, the pawl extension comprising a length of tube anchored at one end in the block, its other end being open and receiving one end of the spring while the other end of the spring is received in a drilling in an adjacent face of the thrust bar in order to secure both spring ends as aforesaid.

4. The tool of claim 2 wherein said connection between the first end of the thrust bar and the movable handle comprises a captive joint providing the third axis and integrally respectively formed in the thrust bar and the movable handle, the joint being laterally operatively offset from the first axis.

5. The tool of claim 4 including an abutment integrally formed in the first member, the first end of the thrust bar engaging the abutment when the handles are in said open position and thereby retaining the spring in tension.

6. The tool of claim 5 wherein the first member comprises the fixed handle and a pair of parallel spaced leaf members integrally formed therewith, the movable handle, drive member, thrust bar, pawl and spring being disposed between the leaf members, and said abutment being formed at the inner end of the fixed handle between the roots of the leaf members.

7. The tool of claim 6 wherein the drive member includes a pair of bosses integrally formed therewith and disposed at its opposite axial ends concentric with and providing the second axis, the bosses being journaled in the leaf members to provide for said rotation of the drive member, the leaf members being springable apart for insertion and removal of the drive member.

8. The tool of claim 7 wherein the movable handle and the pawl are pivoted about removable pins through the leaf members providing the first and fourth axes.

* * * * *